US008622591B1

(12) United States Patent
Liu et al.

(10) Patent No.: US 8,622,591 B1
(45) Date of Patent: Jan. 7, 2014

(54) LED LAMP SCATTERING HEAT BY EXCHANGING CURRENTS

(75) Inventors: Chung-Chi Liu, Taipei (TW); Hua-Zheng Li, Shengzhen (CN)

(73) Assignees: Shenzhen Jiawei Photovoltaic Lighting Co., Ltd., Shenzhen (CN); Light-Core Limited, Shenzhen (CN)

( * ) Notice: Subject to any disclaimer, the term of this patent is extended or adjusted under 35 U.S.C. 154(b) by 0 days.

(21) Appl. No.: 13/600,587

(22) Filed: Aug. 31, 2012

(51) Int. Cl.
*F21V 29/00* (2006.01)

(52) U.S. Cl.
USPC ..... 362/373; 362/249.02; 362/294

(58) Field of Classification Search
USPC ..... 362/249.01, 249.02, 294, 345, 363, 362/373, 382, 650, 800; 313/35, 46, 313/498–500
See application file for complete search history.

(56) References Cited

U.S. PATENT DOCUMENTS 7,575,346 B1 * 8/2009 Horng et al. ..... 362/373
7,874,710 B2 * 1/2011 Tsai et al. ..... 362/373
8,164,237 B2 * 4/2012 Wen ..... 313/46
8,282,250 B1 * 10/2012 Dassanayake et al. ..... 362/373
2010/0060132 A1 * 3/2010 Liu et al. ..... 313/46
2010/0109499 A1 * 5/2010 Vilgiate et al. ..... 313/1
2010/0165632 A1 * 7/2010 Liang ..... 362/294
2011/0037368 A1 * 2/2011 Huang ..... 313/46
2013/0038195 A1 * 2/2013 Petroski et al. ..... 313/35
2013/0128589 A1 * 5/2013 Kim et al. ..... 362/294
2013/0188360 A1 * 7/2013 Chuang ..... 362/294

* cited by examiner

*Primary Examiner* — Hargobind S Sawhney
(74) *Attorney, Agent, or Firm* — Rosenberg, Klein & Lee

(57) ABSTRACT

An LED lamp scattering heat by exchanging currents has a current guider disposed on a seat body. The current guider divides an accommodating chamber of the seat body into at least one first current channel and at least one second current channel. On a periphery of the seat body defines at least one first opening corresponding to the second current channel and at least one second opening defined near a fan of a cooling device. By guiding exterior currents out of the first opening via the second current channel, the exterior currents further enter the second opening of the seat body for being expelled out of the first current channel via the fan to complete an air flow circulation by exchanging currents, which increases the heat radiating efficiency and the using life of the LED lamp and remedies restrictions on installations of the lamp for expanding the lamp application.

6 Claims, 6 Drawing Sheets

LED LAMP SCATTERING HEAT BY EXCHANGING CURRENTS

BACKGROUND OF THE INVENTION

1. Field of the Invention

The present invention relates to a design of an LED lamp, particularly to an LED lamp preferably scattering heat by exchanging currents.

2. Description of the Related Art

Referring to FIG. 1, a conventional LED lamp 1 comprises a seat body 11 including an accommodating chamber 111, a protective cover 10 connected to a rim of the seat body 11, a light module 12 installed within the accommodating chamber 111, and a cooling device 13. Wherein, the light module 12 has an electrically-connected circuit board 121, an optical reflector 122 disposed on the circuit board 121, and at least one LED unit 123 disposed on the circuit board 121. Moreover, the cooling device 13 has a fin set 131 disposed around the optical reflector 122, and a fan 132 disposed under the circuit board 121. In using, the LED unit 123 and the circuit board 121 are electrified for emitting light through the optical reflector 122, and heat generated at the time is released via the fan 132 and the fin set 131.

In practice, referring to FIG. 2, the heat in the LED lamp 1 generated during lighting may be released via the fan 132 and the fin set 131. However, the effect of heat dispersion depends on materials adopted on the fin set 131. Namely, if the fin set 131 is made of appropriate materials, the effect of heat dispersion in the LED lamp 1 favorably advances. Oppositely, if the fin set 131 is made of inappropriate materials, the heat in the LED lamp 1 can not be timely released, which adversely incurs an overheated LED lamp 1. As a result, either the lighting effect or the using life of the LED lamp 1 is influenced.

In fact, where the LED lamp 1 is placed is also one of the factors that influence the effect of heat dispersion. Namely, if the seat body 11 of the LED lamp 1 is uncovered and attached to ceilings, plywood, or any other decorative rails, a favorable effect of heat dispersion could be provided. Oppositely, as shown in FIG. 2, the seat body 11 of the LED lamp 1 may be also embedded in a ground G. A large quantity of wasted heat is similarly generated after the LED unit 123 and the optical reflector 122 continuingly providing light. Herein, since the seat body 11 of the LED lamp 1 is wrapped in the compact ground material G, and the protective cover 10 is designed solid, there is only the narrow and small accommodating chamber 111 left between the fin set 131 and the seat body 11 for wasted heat to be removed out (as shown by dotted-line arrows in FIG. 2) . Herein, cooling air out of the LED lamp 1 can not get in. Thus, the wasted heat generated in time of lighting is difficultly to be dispersed out of the accommodating chamber 111 of the LED lamp 1. Obviously, the LED lamp 1 is thence overheated. Therefore, the lighting effect and the using life of the LED lamp 1 are both affected.

SUMMARY OF THE INVENTION

It is therefore the purpose of this invention to provide an LED lamp scattering heat by exchanging currents. Namely, when the currents are exchanged, circulation of air is constructed for promoting the heat dispersion of the LED lamp and expanding the application of the LED lamp.

The LED lamp scattering heat by exchanging currents in accordance with the present invention comprises a seat body including an accommodating chamber, a light module installed within the accommodating chamber, and a cooling device connected to the light module. Wherein, the light module has an electrically-connected circuit board, an optical reflector disposed on the circuit board, and at least one LED unit disposed on the circuit board. The cooling device has a fan installed under the circuit beard, and a fin set disposed between the circuit board and the fan for enveloping the optical reflector. Heat generated by the LED lamp is scattered by the fan and guided out by the fin set. Wherein, a current guider is installed inside the seat body for dividing the accommodating chamber into at least one first current channel and at least one second current channel. The first current channel accommodates the light module. On a periphery of the seat body defines at least one first opening that is disposed correspondingly to the second current channel, and at least one second opening that is disposed near the fan. The second current channel is able to communicate with an exterior of the seat body via the first opening. The second opening is disposed direct to communicate with the fan, thereby introducing external currents into the second current channel, then guiding the external currents out of the first opening, and thence allowing the external currents to enter the second opening of the seat body and meet the fan by which the external air hence emanates from the first current channel.

Preferably, the current guider includes a main body and a plurality of fin units extended from the main body.

Preferably, a protective cover is connected to a rim of the seat body, and the protective cover provides a plurality of openings formed thereon for communicating with the first current channel and the second current channel.

Preferably, the current guider can be installed on the protective cover.

Preferably, the current guider is integrally attached to the protective cover, facilitating a division of the first current channel and the second current channel in the accommodating chamber when the protective cover is connected to the seat body.

Accordingly, exterior currents are introduced for forming current circulation to effectively cool the heat generated in the LED lamp. As a result, the heat can be favorably scattered, so the installing location of the LED lamp is unlimited. Accordingly, the LED lamp can be more expansively installed and used.

DETAILED DESCRIPTION OF THE PREFERRED EMBODIMENTS

Figure 1:
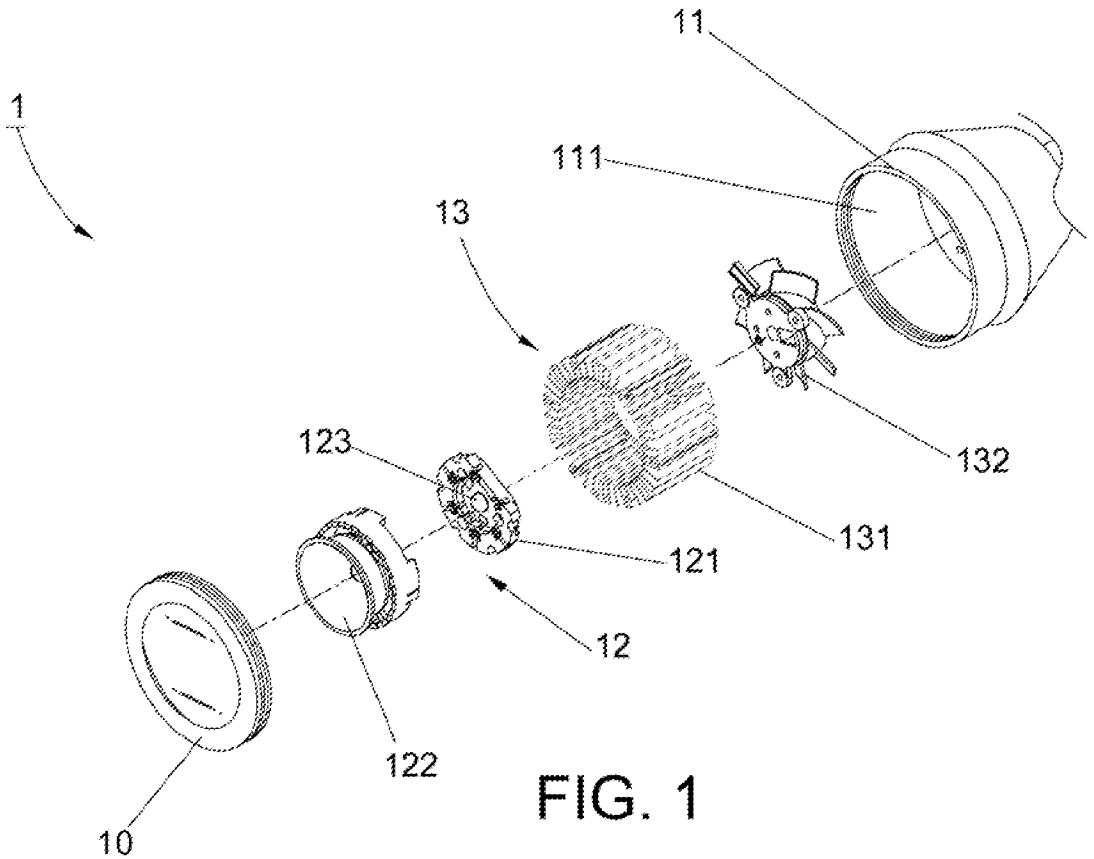
FIG. 1 (PRIOR ART)
FIG. 1 is a schematic view showing a conventional LED lamp.
Figure 2:
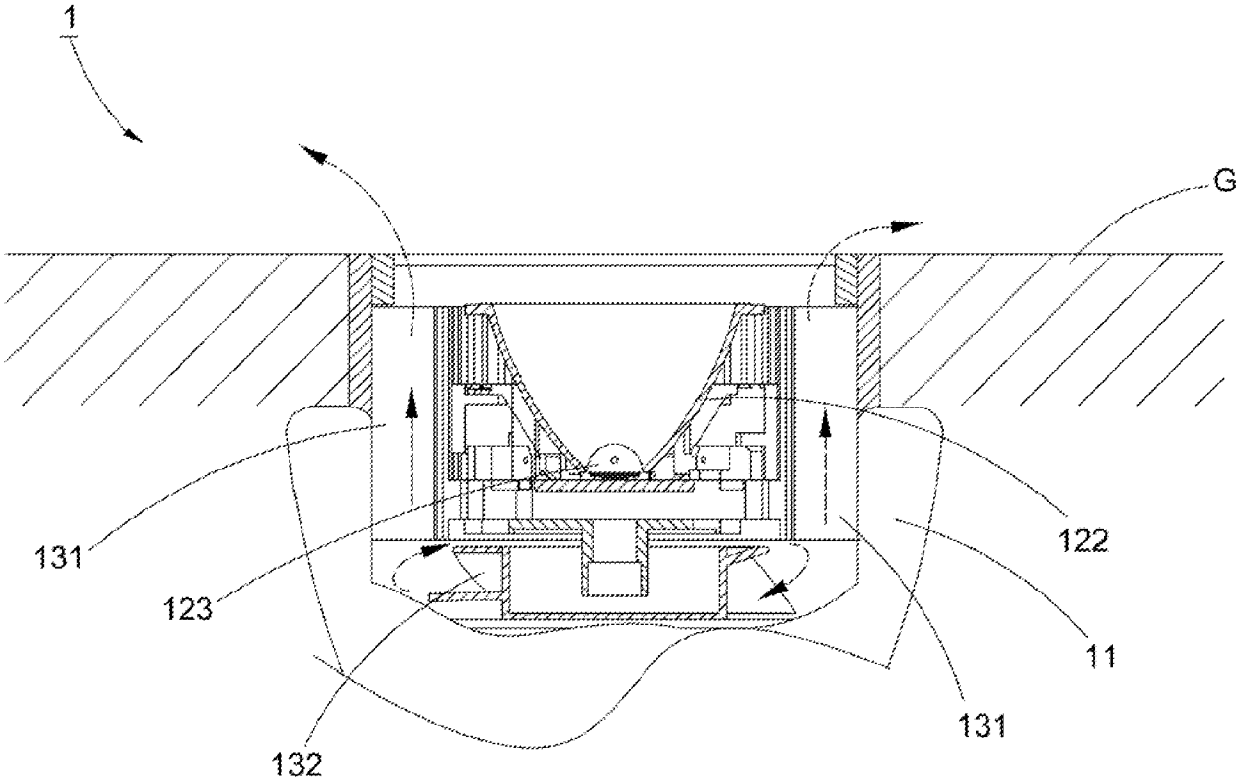
FIG. 2 (PRIOR ART)
FIG. 2 is a cross-sectional view of the conventional LED lamp.

Wherever possible, the same reference numbers are used in the drawings and the description to refer to the same or like parts.

Figure 3:
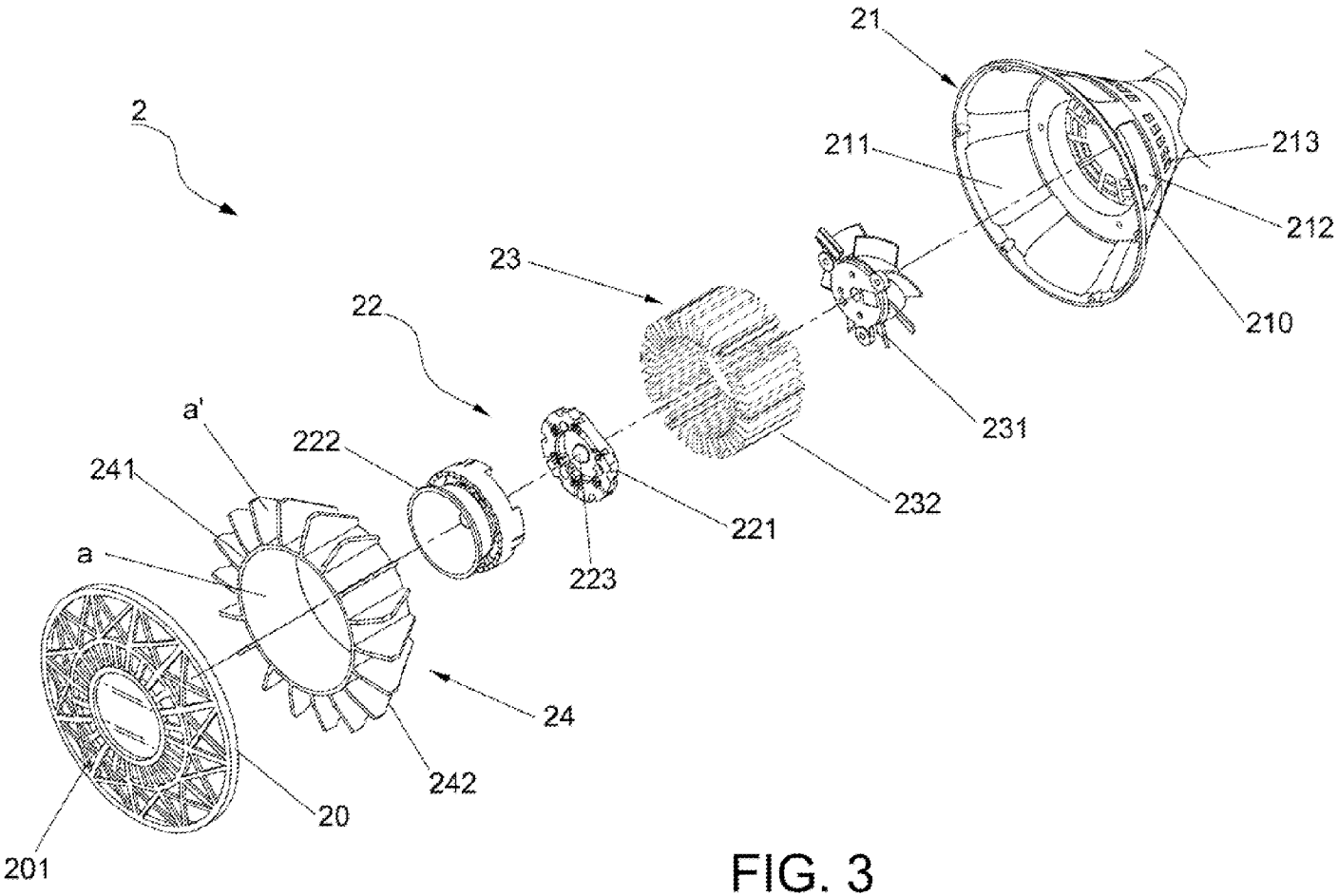
FIG. 3 is a schematic view showing a first preferred embodiment of the present invention.

Referring to FIG. 3, a first preferred embodiment of the present invention is shown. An LED lamp 2 scattering heat by exchanging currents comprises a seat body 21 including an accommodating chamber 211, a protective cover 20 connected to a rim of the seat body 21, a light module 22 installed within the accommodating chamber 211, a cooling device 23 correspondingly disposed to the light module 22, and a current guider 24 installed inside the seat body 21 for adaptively accommodating the light module 22 . Further, the light module 22 has an electrically-connected circuit board 221, an optical reflector 222 disposed on the circuit board 221, and at least one LED unit 223 disposed on the circuit board 221. Herein, the LED unit 223 provides light through the optical reflector 222. Moreover, the cooling device 23 has a fan 231 installed under the circuit board 221, and a fin set 232 disposed between the circuit board 221 and the fan 231 for enveloping the optical reflector 222.

Continuingly, the current guider 24 divides the accommodating chamber 211 into at least one first current channel a and at least one second current channel a'. In this embodiment, the current guider 24 has a main body 241 that separates the first current channel a from the second current channel a', and a plurality of fin units 242 outward extended from the main body 241. Concurrently, the first current channel a can adaptively accommodate the light module 22. Further, on a periphery of the seat body 21 defines at least one first opening 212 that is disposed correspondingly to the second current channel a' and at least one second opening 213 that is disposed near the fan 231. The second current channel a' is able to communicate with an exterior of the seat body 21 via the first opening 212. The second opening 213 is disposed direct to the fan 231, thereby introducing external currents into the second current channel a', then guiding the external currents out of the first opening 212, and thence allowing the external currents to enter the second opening 213 of the seat body 21 and meet the fan 231 by which the external air hence emanates from the first current channel a. Obviously, a current exchanging mode is achieved by the fan 231 helping currents of air to be exchanged between the first current channel a and the second current channel a'.

Additionally, the protective cover 20 can be freely adopted for preferably preventing foreign objects from intrusion in the seat body 21, and openings 201 defined thereon can further communicate with the first current channel a and the second current channel a'.

Figure 4:
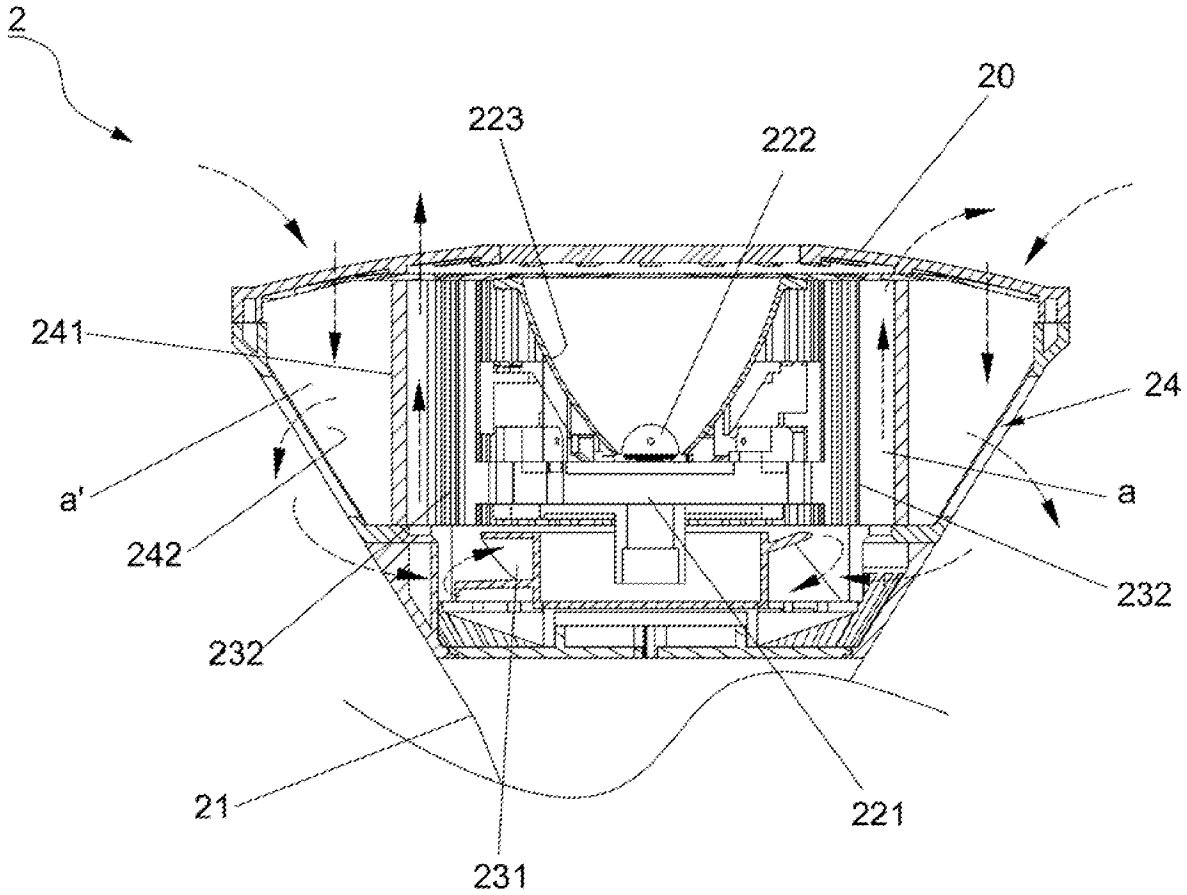
FIG. 4 is a cross-sectional view of the first preferred embodiment of the present invention.

Referring to FIGS. 3 and 4, in using, the LED unit 223 and the circuit board 221 are electrified to emit light. Namely, the light goes through the optical reflector 222 and then illuminates any desired places. Concurrently, the fan 231 under the circuit board 221 is driven during the illumination. When the LED unit 223 keeps lighting, the seat body 21 is full of wasted heat. Herein, besides the fin set 232, the fan 231 also timely operates and the current guider 24 executes the heat dispersion to guide the wasted heat. At the same time, exterior currents enter the accommodating chamber 211 through the openings 201 and the second current channel a'. Accordingly, the fin units 242 are firstly cooled by the entry of exterior currents of air. The exterior currents of air in the second current channel a' thence go out of the seat body 21 via the first opening 212 and then get in the seat body 21 again via the second opening 213. Accordingly, the currents of air are mixed with the wasted heat in the fin set 232 and expelled via the first current channel a and the openings 201 by the blowing from the fan 231 (as shown by dotted-line arrows in FIG. 4). Accordingly, the current guider 24, the first opening 212, and the second opening 213 are able to guide the exterior currents of air into the seat body 21 and thence bring about circulation of air in the LED lamp 2.

Whereby, no matter the LED lamp 2 is placed in an exposed manner or a hidden manner, the current guider 24, the first opening 212, and the second opening 213 cooperatively promote the effect of heat scattering on the LED lamp. Namely, the wasted heat can be scattered by the fin set 232, mixed with external currents of air, and blown by the fan 231 for introducing the circulation of currents to enhance the heat dispersing effect. Further, the LED lamp 2 does not overheat, and the using life of the LED unit 222 can be prolonged. Favorably, the installing location of the LED lamp 2 becomes free and more expansive now since the heat dispersing problem is resolved.

Figure 5:
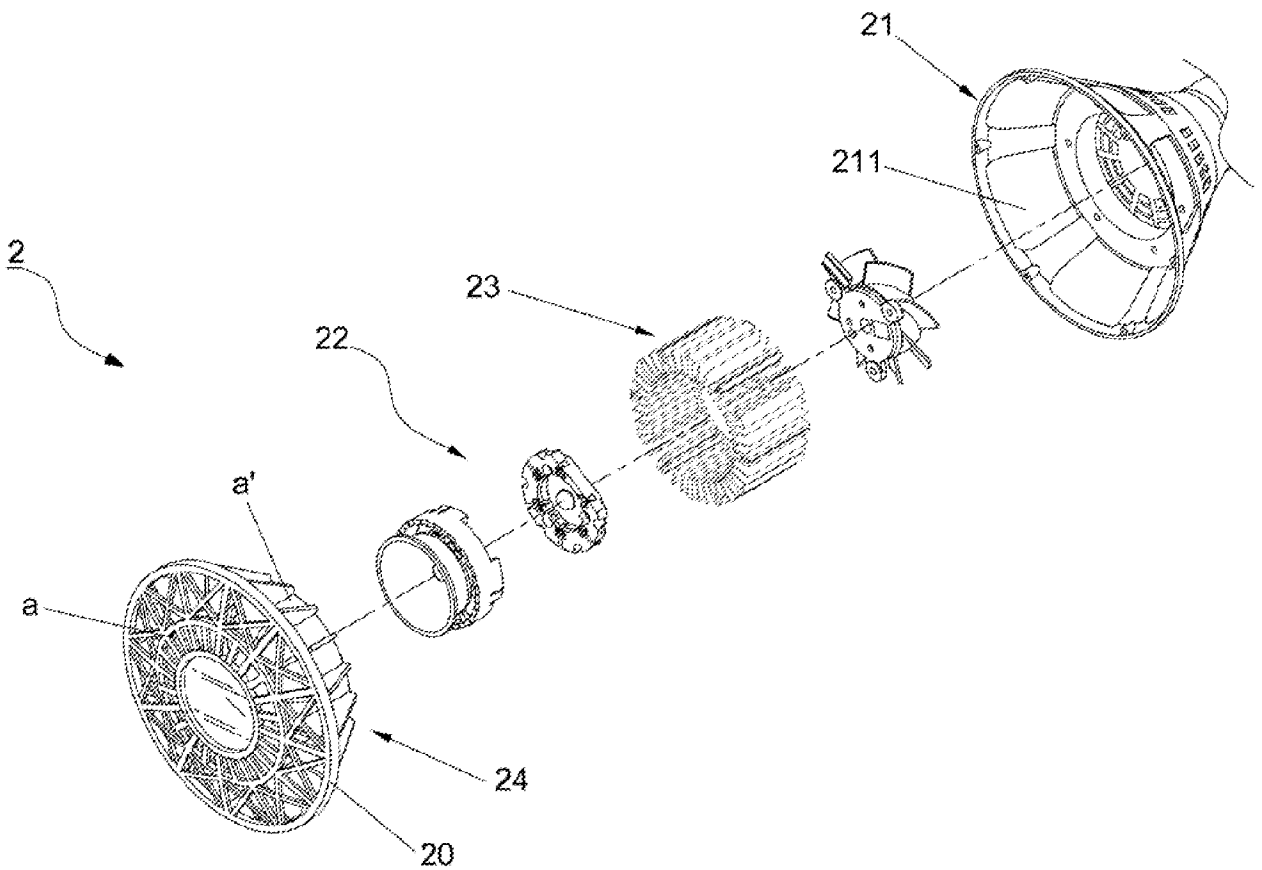
FIG. 5 is a schematic view showing a second preferred embodiment of the present invention.
Figure 6:
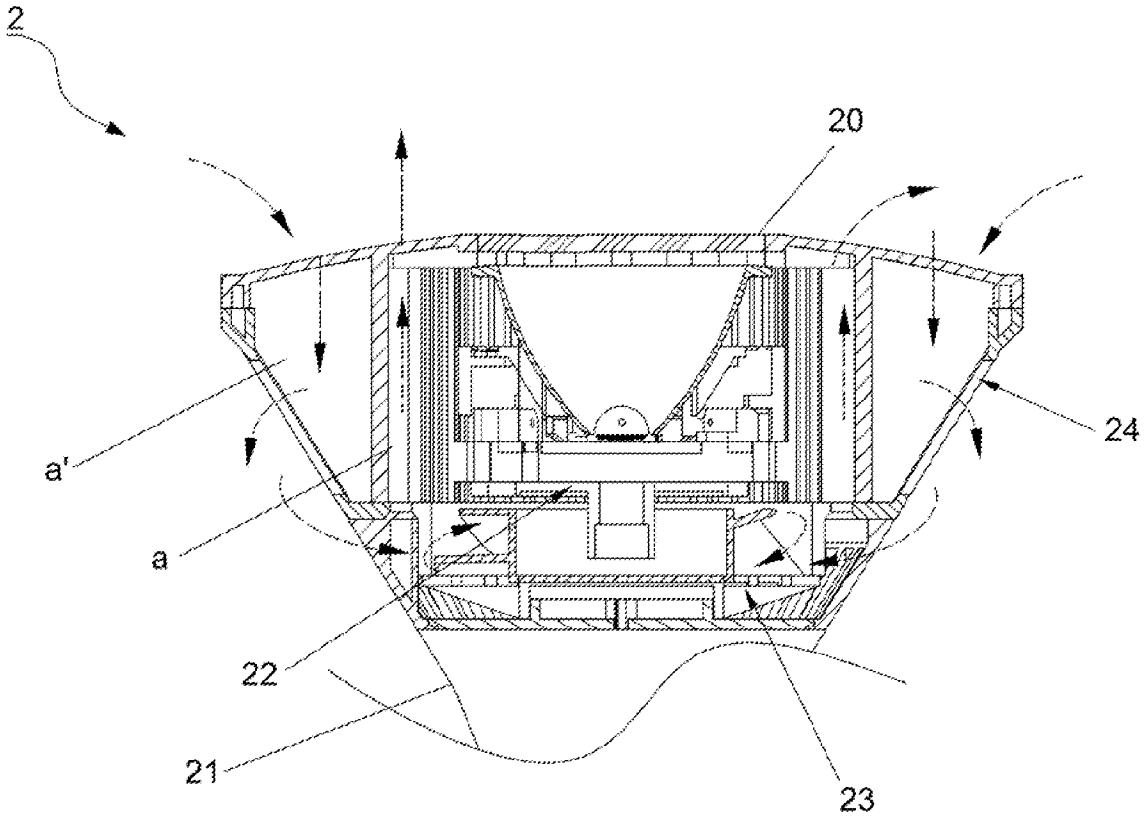
FIG. 6 is a cross-sectional view of the second preferred embodiment of the present invention.

Referring to FIGS. 5 and 6, a second preferred embodiment of the present invention is shown. A protective cover 20, a seat body 21, a light module 22, a cooling device 23, a current guider 24, and other components are similarly included by an LED lamp 2 for achieving the same function as that of previous embodiment. Differently, the current guider 24 is integrally attached to the protective cover 20. Whereby, when the protective cover 20 is disposed onto the seat body 21, the current guider 24 similarly divides the accommodating chamber 211 into the first current channel a and the second current channel a'. Accordingly, the effect of current circulation can be also introduced as that of the previous preferred embodiment.

To sum up, the present invention particularly utilizes the current guider and the first opening as well as the second opening defined on the periphery of the seat body to scatter wasted heat generated in the LED lamp via the circulation of currents. Namely, the current guider introduces exterior currents of air to cool and exchange with the wasted heat in the LED lamp. Accordingly, the fan preferably expels the wasted heat, which enhances the effect of heat dispersion. As a result, the installing location of the LED lamp is not limited anymore, and the using scope of the LED lamp is promoted.

While we have shown and described the embodiment in accordance with the present invention, it should be clear to those skilled in the art that further embodiments may be made without departing from the scope of the present invention.

We claim:

1. An LED lamp scattering heat by exchanging currents comprising a seat body including an accommodating chamber, a light module installed within said accommodating chamber, and a cooling device connected to said light module; wherein, said light module has an electrically-connected circuit board, an optical reflector disposed on said circuit board, and at least one LED unit disposed on said circuit board; said cooling device having a fan installed under said circuit board, and a fin set disposed between said circuit board and said fan for enveloping said optical reflector; heat generated by said LED lamp being scattered by said fan and guided out by said fin set;

wherein, a current guider is installed inside said seat body for dividing said accommodating chamber into at least one first current channel and at least one second current channel; said first current channel accommodating said light module; on a periphery of said seat body defining at least one first opening that is disposed correspondingly to said second current channel and at least one second opening that is disposed near said fan; said second current channel being able to communicate with an exterior of said seat body via said first opening; said second opening being disposed direct to said fan, thereby introducing external currents into said second current channel, then guiding said external currents out of said first opening, and thence allowing said external currents to enter said second opening of said seat body and meet said fan by which said external air hence emanates from said first current channel.

2. The LED lamp as claimed in claim 1, wherein, said current guider includes a main body and a plurality of fin units extended from said main body.

3. The LED lamp as claimed in claim 2, wherein, a protective cover is connected to a rim of said seat body, and said protective cover provides a plurality of openings formed thereon for communicating with said first current channel and said second current channel.

4. The LED lamp as claimed in claim 3, wherein, said current guider is integrally attached to said protective cover, facilitating a division of said first current channel and said second current channel in said accommodating chamber when said protective cover is connected to said seat body.

5. The LED lamp as claimed in claim 1, wherein, a protective cover is connected to a rim of said seat body, and said protective cover provides a plurality of openings formed thereon for communicating with said first current channel and said second current channel.

6. The LED lamp as claimed in claim 5, wherein, said current guider is integrally attached to said protective cover, facilitating a division of said first current channel and said second current channel in said accommodating chamber when said protective cover is connected to said seat body.

* * * * *